US005182574A

United States Patent [19]

Kato et al.

[11] Patent Number: 5,182,574

[45] Date of Patent: Jan. 26, 1993

[54] THERMAL HEAD

[75] Inventors: Masakazu Kato, Morioka; Takatoshi Ishikawa, Fukuoka; Tetsuo Ishikawa, Tamayama, all of Japan

[73] Assignee: Alps Electric Co., Ltd., Tokyo, Japan

[21] Appl. No.: 739,960

[22] Filed: Aug. 5, 1991

[30] Foreign Application Priority Data

Aug. 9, 1990 [JP] Japan ..... 2-212308
Aug. 9, 1990 [JP] Japan ..... 2-212309

[51] Int. Cl.[5] ..... B41J 2/335
[52] U.S. Cl. ..... 346/76 PH
[58] Field of Search ..... 346/76 PH

[56] References Cited

FOREIGN PATENT DOCUMENTS 0063459 4/1986 Japan ..... 346/76 PH

*Primary Examiner*—Benjamin R. Fuller
*Assistant Examiner*—Huan Tran
*Attorney, Agent, or Firm*—Guy W. Shoup; David W. Heid; Noel B. Kivlin

[57] ABSTRACT

A thermal head for a thermal-transfer or heat-sensitive printer has a silicon substrate having a projection. A porous silicon layer having a small thermal conductivity is formed on the silicon substrate so as to cover at least the projection on the silicon substrate. A heat-generating resistor layer is formed on the porous silicon oxide layer in a region above the projection of the silicon substrate. A conductor layer is formed on the heat-generating layer so as to expose the portion of the heat-generating resistor layer which is right above the projection of the silicon substrate and which serves as a heat-generating portion. The heat-generating portion and the conductor layer are covered by a protective layer.

9 Claims, 7 Drawing Sheets

THERMAL HEAD

BACKGROUND OF THE INVENTION

1. Field of the Invention

The present invention relates to a thermal head for use in thermal transfer type printers or heat-sensitive type printers and more particularly, to a thermal head of the type in which a heat-generating portion is provided on a projecting portion of a substrate.

2. Description of the Related Art

FIG. 18 shows a known thermal printer head. This thermal printer head has an aluminum substrate 1 which is locally covered by a heat-accumulation layer 2 of glass glaze. A heat-generating resistor layer 3 is formed on the heat-accumulation layer 2 and the substrate 1. A conductor layer 4 for supplying electrical current to the heat-generating resistor layer 3 is formed on the layer 3. A heat-generating portion 6, composed of the resistor layer 3 exposed through the conductor layer 4, is formed in a dot-like form. A protective layer 5 is formed on the dot-like heat generating portion 6 to protect the latter from oxidation and wear.

This thermal head is used in contact with a recording medium (not shown) such as an ink ribbon or a heat-sensitive paper. When an electrical current is supplied to the heat-generating portion 6 of the thermal head, heat is generated to transfer an ink in an ink ribbon to the recording medium or enables coloring component in the recording medium to develop a color, whereby information is recorded on the recording medium.

The thermal response characteristic is improved to enable high-speed printing when the glass glaze heat-accumulation layer is thinned as shown in FIG. 19. In such a case, however, the pressure at which the dot-like heat-generating portion 6 is pressed against the ink ribbon is reduced because the amount of projection or height of the heat-generating portion 6 is reduced correspondingly. This causes various inconveniences such as impairment of printing quality and efficiency, as well as increase in the electrical power consumption. Printing quality and efficiency would be improved when the projection height of the heat-generating portion 6 is increased by an increase in the glass heat-accumulation layer 2 as shown in FIG. 20, because in such a case the heat-generating portion 6 can be pressed onto the ink ribbon at higher pressure. In such a case, however, the thermal capacity of the thermal head is increased due to increase in the thickness of the glass glaze heat-accumulation layer 2, with the result that the thermal response characteristic of the thermal head is impaired to, and thus inhibits high-speed printing.

SUMMARY OF THE INVENTION

Accordingly, an object of the present invention is to provide a thermal head which offers an improvement in printing efficiency, i. e. a reduction in the electrical power consumption, without being accompanied by degradation of the printing quality.

To this end, according to one aspect of the present invention, there is provided a thermal head comprising: a silicon substrate having a projection; a porous silicon oxide layer formed at least on the projection of the silicon substrate; a heat-generating resistor layer formed on the porous silicon oxide layer in the region above the projection of the silicon substrate; a conductor layer formed on the heat-generating resistor layer so as to expose only a portion of the heat-generating resistor layer which is positioned above the projection and which serves as a heat-generating portion; and a protective layer formed to cover the heat-generating portion and the conductor layer.

According to a second aspect of the invention, there is provided a thermal head comprising: a silicon substrate having a projection; a porous silicon oxide layer formed to cover only the crest of the projection of the silicon substrate; a heat-generating resistor layer formed on the porous silicon oxide layer in the region above the projection of the silicon substrate; a conductor layer formed on the heat-generating resistor layer so as to expose only a portion of the heat-generating resistor layer which is positioned above the projection and which serves as a heat-generating portion; and a protective layer formed to cover the heat-generating portion and the conductor layer.

The term "crest of the projection" is used in this specification to mean a region encircled by a circle which is centered at the center of the projection and which has a diameter about 5 to 10 μm greater than the distance between the portions of the conductor layer opposing each other across the heat-generating portion and having a depth of 10 to 40 μm the thicknesswise direction of the silicon substrate.

The thermal head in accordance with the first aspect of the present invention provides superior printing quality because the heat-generating portion, which is provided on the crest of projection formed on a silicon substrate, can be pressed onto an ink ribbon or a recording medium such as a heat-sensitive paper at a sufficiently high pressure. In addition, the porous silicon oxide layer having a small thermal conductivity, provided at least on the projection of the substrate, reduces the rate of transfer and conduction of heat from the heat-generating resistor layer to the silicon substrate, thus improving printing efficiency.

The effect to reduce the heat transfer and conduction is not appreciable when the thickness of the porous silicon oxide layer is below 10 μ, whereas any porous silicon oxide layer thickness exceeding 100 μm causes the heat transferred to the porous silicon oxide layer to be accumulated in this layer, with the result that the thermal response characteristic is impaired to inhibit high-speed printing.

The thermal head in accordance with the second aspect of the invention also offers improvement in the printing quality because the heat-generating portions, which are provided on the crest of projection formed on a silicon substrate, can be pressed onto an ink ribbon or a recording medium such as a heat-sensitive paper at a sufficiently high pressure, as in the case of the thermal head of the first aspect. Furthermore, the porous silicon oxide layer having small thermal conductivity is provided only on the crest of the projection of the silicon substrate so that the area of boundary between the heat-generating portion and other portions of the substrate per unit area of the porous silicon oxide layer is increased. In addition, the substrate is made of a silicon wafer which exhibits greater thermal conductivity than alumina which has been used conventionally. Therefore, when the thermal head operates, the transfer of heat from the heat-generating portion to the substrate is reduced, as compared with the case where the porous silicon oxide layer is not provided, whereas, when the heating is terminated, the time required for the temperature of the heat-generating portion to drop is shortened as compared, with the case where the porous silicon oxide layer is formed over a wide area, thus enabling highspeed printing.

The above and other objects, features and advantages of the present invention will become more clear from the following description of the preferred embodiments when the same is read in conjunction with the accompanying drawings.

DESCRIPTION OF THE PREFERRED EMBODIMENTS

Figure 1:
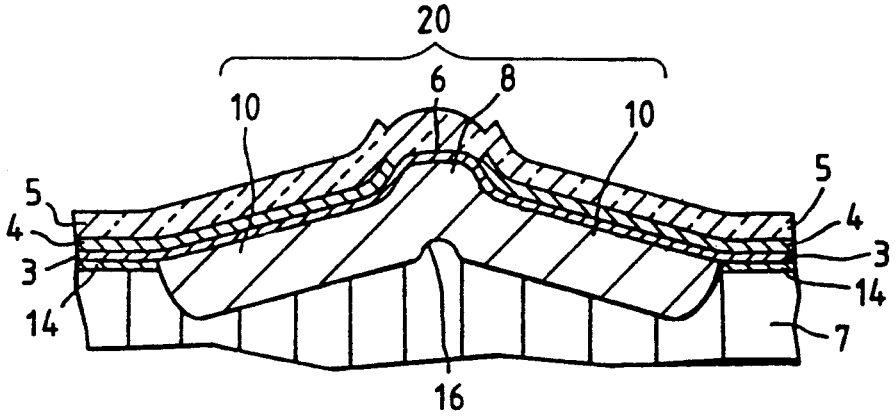
FIG. 1 is a sectional view of an embodiment of a thermal head in accordance with the present invention.

Referring to FIG. 1, a first embodiment of the thermal head in accordance with the present invention has a substrate 7 which is made of silicon. The substrate 7 has a protrusion 20. The protrusion 20 has a projection 8 which projects to form a crest of the protrusion with a steep slope and a peripheral skirt portion 10 of a gentle slope or gradient surrounding the projection 8. A porous silicon oxide layer 16 of 10 to 100 μm thick is formed on the substrate 7 so as to cover the protrusion including the projection 8 and the skirt portion 10. An $SiO_2$ film 14 is formed on the regions of the silicon substrate where the porous silicon oxide layer 16 is not formed. The porous silicon oxide layer 16 and the $SiO_2$ film 14 are covered by a heat-generating resistor layer 3 made of, for example, $Ta_2N$, Ta-Cr-N, Ta-$SiO_2$ or the like and having a thickness ranging between 0.05 and 0.3 μm. On the heat-generating resistor layer 3 is formed a conductor layer 4 so as to locally expose the heat-generating resistor layer 3 in the heat-generating portion 6 above the projection 8, the conductor layer 4 being made of, for example, Al, Ni-Cr/Au or the like and having a thickness of 1 to 2 μm. A protective layer 5 of 5 to 7 μm and made of, for example, $SiO_2/Ta_2O_5$, thialone or the like, is formed to cover the conductor layer 4 and the heat-generating portions 6 exposed through the latter.

In this embodiment, the heat-generating portion 6, which is formed above the projection 8 of the protrusion 20 of the silicon substrate 7, can be pressed onto the ink ribbon or the recording medium such as heat-sensitive paper, thus ensuring high printing efficiency and quality.

Furthermore, the porous silicon oxide layer 16 of 10 to 100 μm thick, formed on the substrate 7 to cover the projection 8 and the peripheral skirt portion 10 of the protrusion 20, serves to suitably reduce the transfer of heat from the heat-generating resistor layer 3 to the silicon substrate 7.

This thermal head, therefore, can operate with a reduced electrical power consumption, contributing also to the improvement in the printing efficiency.

PRODUCTION EXAMPLE

An example of the process for producing the thermal head of the first embodiment will be described with specific reference to FIGS. 2 to 17. The process is composed mainly of three major steps: namely, a step for preparing a silicon substrate having, a projection, a step for forming a porous silicon oxide layer on the substrate, and a step for fabricating the thermal heat using the substrate having the porous silicon oxide layer.

The first step for forming the silicon substrate with projections was carried out as follows.

Figure 2:
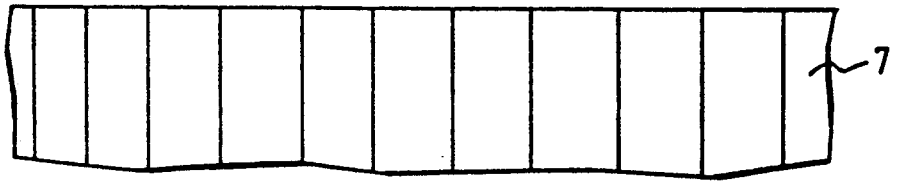
FIGS. 2 to 16 are sectional views of the the embodiment of the thermal head shown in FIG. 1 in different steps of a process for producing the thermal head.

(1) A silicon substrate 7 as shown in FIG. 2 was prepared. The silicon substrate 7 was a P-type substrate having a resistivity of 0.01 Ω·cm.

Figure 3:
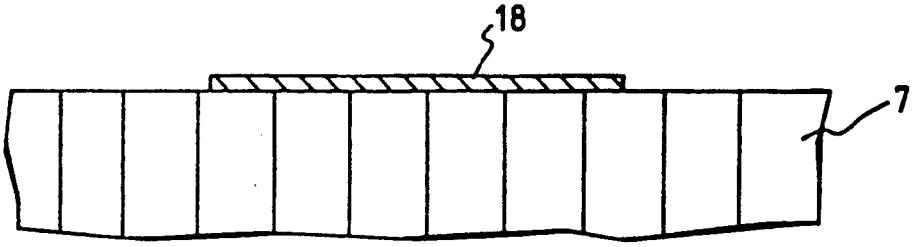

(2) A masking liquid (CBR-M901 produced by Nippon Gosei Gomu) was applied to the silicon substrate 7 by spin coating. The silicon substrate 7 was then exposed though the masking liquid and then subjected to a development, whereby a mask 18 was formed as shown in FIG. 3. The width of the mask was 500 μm.

Figure 4:
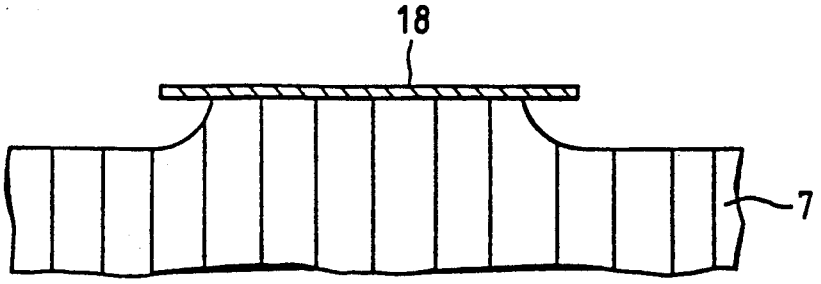
Figure 5:
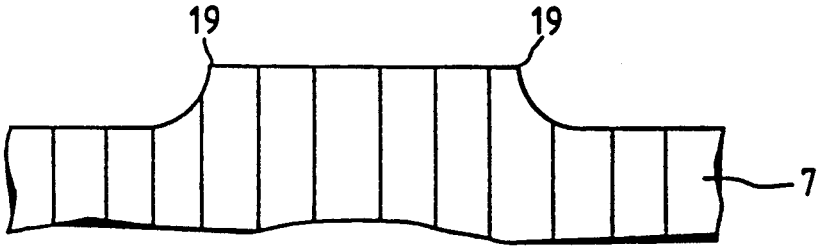

(3) Subsequently, etching was conducted for 3 minutes by using an acidic mixture, composed of 79 wt % of fluoric acid, 3 wt % of nitric acid and 18 wt % of acetic acid. As a result, the silicon substrate 7 was etched to a depth of about 30 μm. As shown in FIG. 4, the etching was effected such that portions of the silicon substrate beneath each mask 18 was partly removed.

(4) The mask 18 was then separated by using a mixture solution of sulfuric acid and aqueous hydrogen peroxide, whereby a protrusion 9 having edges 19 were left on the silicon substrate 7.

Figure 6:
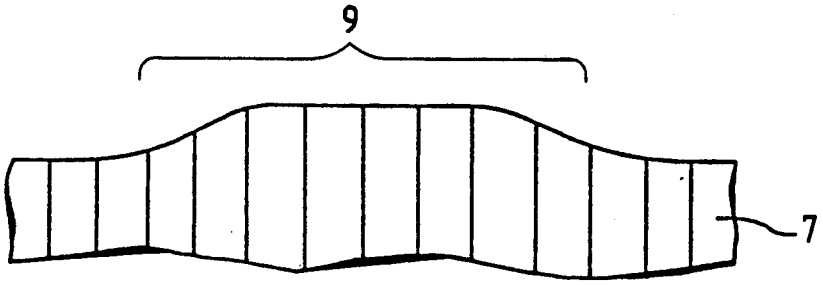
Figure 7:
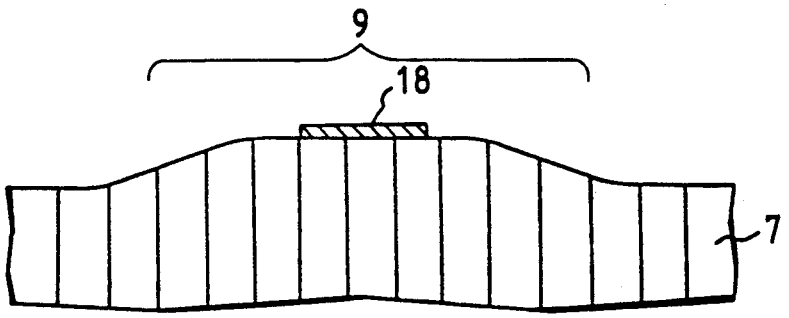
Figure 8:
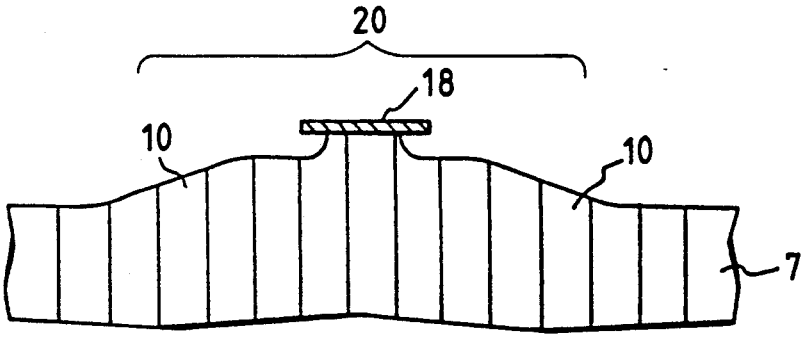
Figure 9:
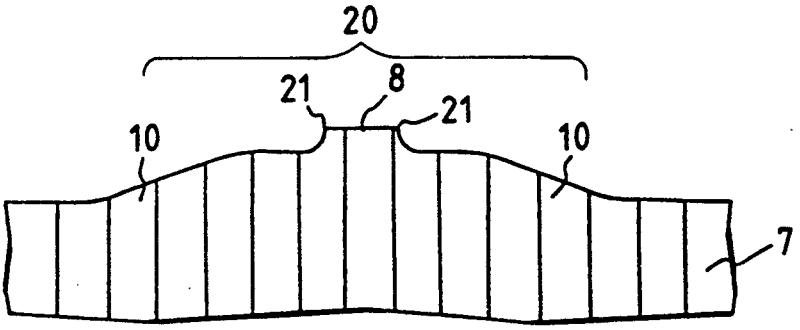

(5) Subsequently, the silicon substrate 7 was immersed for 6 minutes in an acidic mixture containing 10 wt % of fluoric acid, 80 wt % of nitric acid and 10 wt% of acetic acid so that edges 19 were removed to leave the protrusion 9 in a form as shown in FIG. 6.

(6) Then, a masking liquid (CBR-M901 produced by Nippon Gosei Gomu) was applied to the silicon substrate 7 by spin coating method and the substrate 7 was subjected to exposure and development, whereby a mask 18 having a width of 100 μm was formed on the center of the silicon substrate 7.

(7) Then, etching was conducted for 1 minute by using the same acidic mixture as that used in the previous step (3), whereby the substrate 7 as etched at its region along the periphery of the mask 18 to a depth of about 10 μm.

(8) Then, the mask 18 was removed by using a mixture liquid of sulfuric acid and aqueous hydrogen peroxide as in the previous step (4), whereby a projection 8 of about 10 μm tall was left on the center of the protrusion on the silicon substrate 7.

Figure 10:
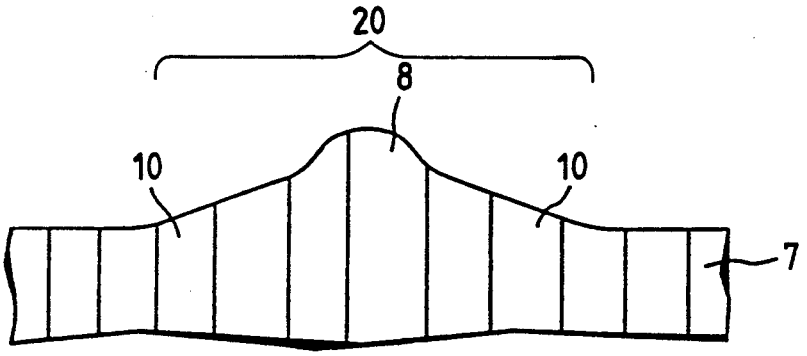

(9) The silicon substrate 7 was then etched by the same acidic mixture as that used in the previous step (5) so as to remove edge 21 of the projection 8, whereby a protrusion 10 including a central projection 8 and a peripheral skirt portion 10 was left on the silicon substrate as shown in FIG. 10.

The second step for forming the porous silicon oxide layer was conducted in the following manner.

Figure 11:
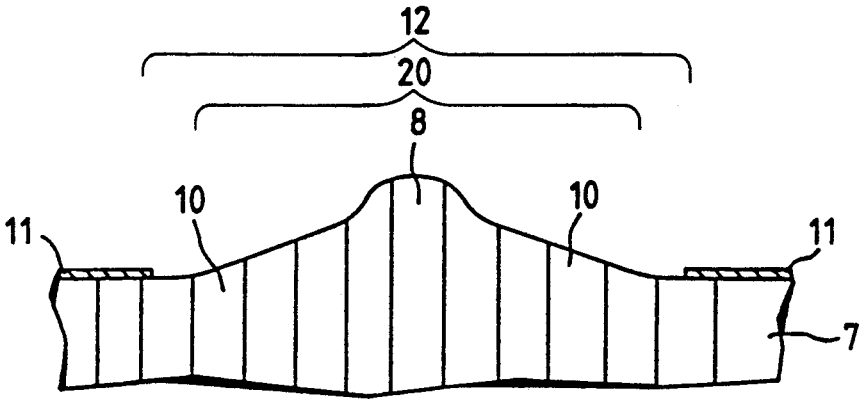
Figure 12:
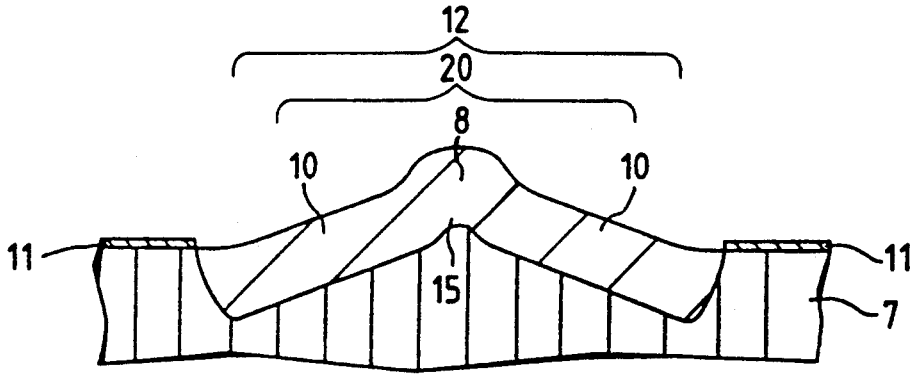
Figure 13:
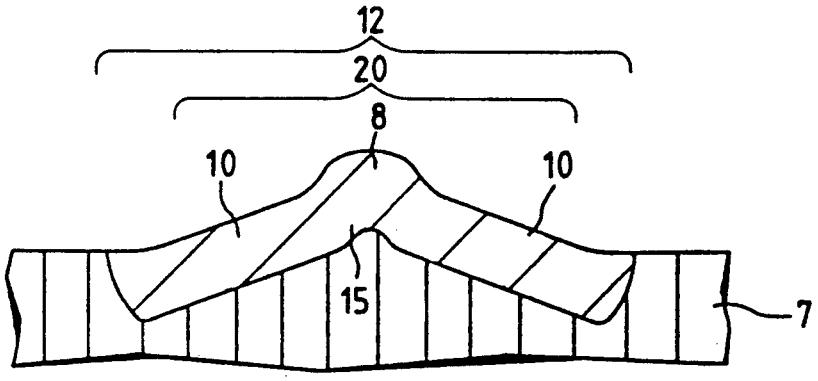

(1) As shown in FIG. 11, a mask 11 of a photo-resist (CBR-M901 produced by Nippon Gosei Gomu) was formed on the silicon substrate 7 of FIG. 10. The mask 11 was partly removed to expose the surface of the silicon substrate 7 by photolithographic etching at the portion thereof where the porous silicon oxide layer is to be formed.

(2) Meanwhile, 20 wt % aqueous solution of hydrofluoric acid was charged in an electrolytic cell having a platinum plate serving as a cathode, and the silicon substrate 7 was immersed in the solution so as to face the platinum plate and so as to serve as an oxide. Anodic chemical conversion treatment was then effected with a D.C. current. The current density and the treating time were respectively 50 $mA/cm^2$ and 20 minutes.

The photo-resist mask 11 formed on the silicon substrate 7 could function as a mask without fail, because it was not corroded by hydrogen fluoric acid. As a consequence, a porous silicon layer 15 having a thickness of 40 μm and a porosity of 80% was formed only on the portion of the silicon substrate 7 devoid of the mask 11, i.e., only on the region 12 where the porous silicon oxide layer is to be formed. The thickness of the porous silicon layer 15 could be freely controlled by varying the time of the anodic chemical conversion.

(3) After a sufficient rinsing, the silicon substrate 7 was subjected to a step for removing the mask 11 by a mixture liquid of fluoric acid and aqueous hydrogen peroxide.

Figure 14:
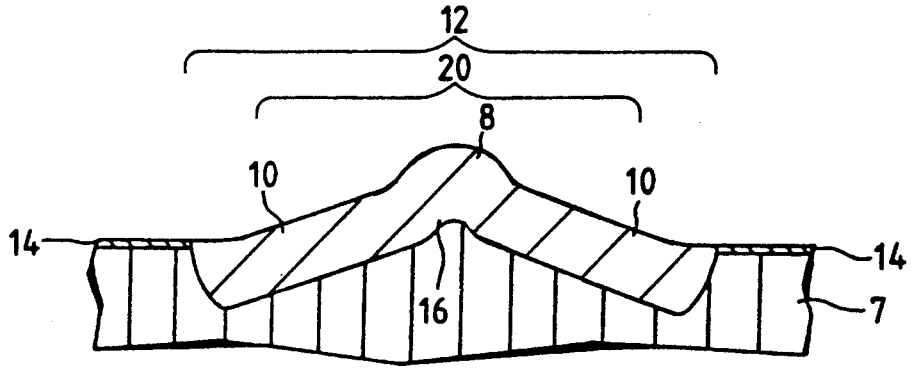

(4) The silicon substrate was then sufficiently rinsed and left in the atmospheric air at 850° to 1000° C. for heat oxidation, whereby the porous silicon layer 15 was oxidized. As a result, the porous silicon layer 15 was changed into a porous siliconoxide layer 16 covering the protrusion 20 and a surrounding region as shown in FIG. 14. The surface of the silicon substrate 7 also was oxidized during the above-mentioned heat-oxidation, whereby an $SiO_2$ film 14 of 0.05 to 0.1 μm, thick was formed around the porous silicon oxide layer 16.

The silicon substrate thus prepared may be coated, as necessitated, with a film of non-porous silicon oxide or a non-porous insulating film such as thialon formed by sputtering.

The third step for fabricating the thermal head using this substrate was conducted in the following manner.

Figure 15:
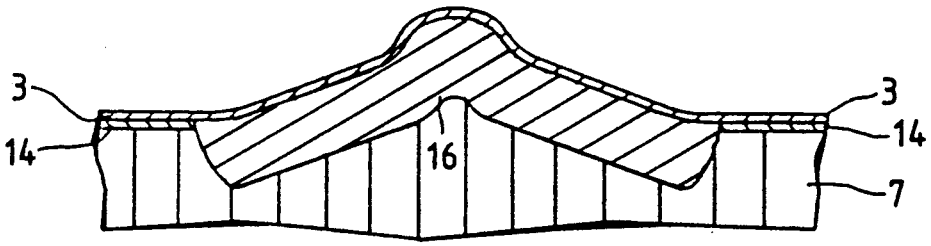
Figure 16:
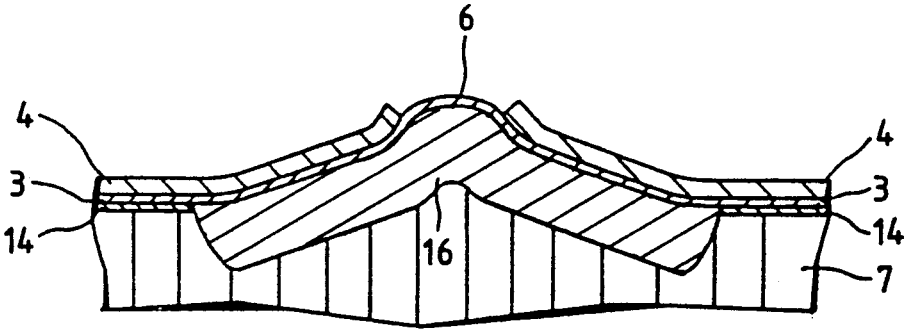

(1) A heat-generating resistor layer 3 as shown in FIG. 15 was formed on the silicon substrate 7 having the porous silicon oxide layer 16 by sputtering with $Ta_2N$, Ta-Cr-N or Ta-$SiO_2$. The thickness of this heat-generating resistor layer 3 was 0.05 to 0.3 μm.

(2) Subsequently, a conductor layer 4 of 1 to 2 μm thick (2) Subsequently, was formed on the heat-generating resistor layer 3 by evaporation form A or Ni-Cr/Au. and the portion of the conductor layer 4 above the projection 8 was removed by photolithographic etching, thus forming a heat-generating portion 6, whereby the heat-generating resistor layer 3 and the conductor layer 4 were connected together at both sides of the porous silicon oxide layer 16.

(3) Then, a protective layer of 5 to 7 μm thick was formed by sputtering from $SiO_2/Ta_2O_5$ or thialon, whereby a thermal head as shown in FIG. 1 was completed.

A description will now be given of a second embodiment of the invention.

Figure 17:
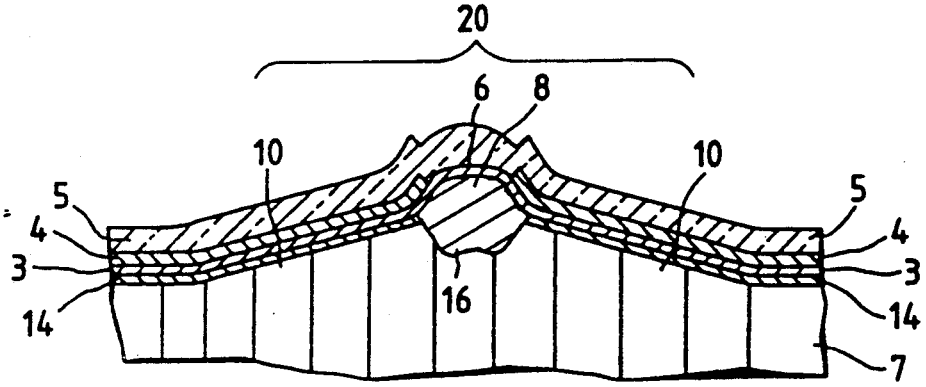
FIG. 17 is a sectional view of a second embodiment of the thermal head in accordance with the present invention.
Figure 18:
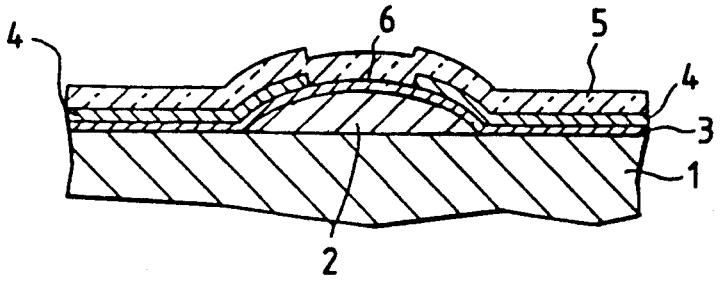
FIG. 18 PRIOR ART
FIGS. 18 to 20 are sectional views of conventional thermal heads with heat-accumulation layers formed of glass glaze.
Figure 19:
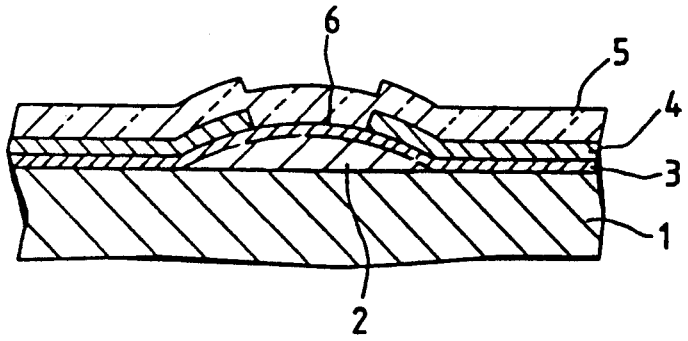
FIG. 19 PRIOR ART
Figure 20:
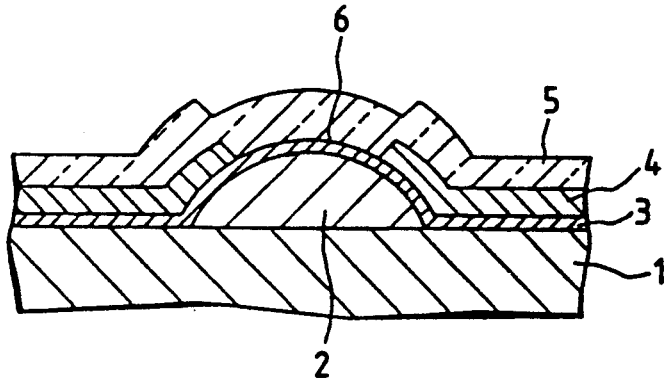
FIG. 20 PRIOR ART

FIG. 17 shows a second embodiment of the thermal head of the present invention. The second embodiment is basically the same as the first embodiment except that the porous silicon oxide layer of a specific thickness, preferably 10 to 40 μm, is formed only on the crest of the projection 8.

In this embodiment,therefore, the heat-generating portion 6 is provided above the projection 8 of the protrusion on the silicon substrate 7, so that the heat-generating portion 6 can be pressed at a sufficiently high pressure to an ink ribbon or a recording medium such as a heat-sensitive paper, thus ensuring high printing quality as in the case of the first embodiment.

In the second embodiment, the porous silicon oxide layer having a small thermal conductivity is provided to have a thickness of 10 to 40 μm only on the crest of the projection 8 so as to minimize the area of boundary between the porous silicon oxide layer 16 and the substrate 7 per unit area of the porous silicon oxide layer. In addition, a silicon wafer which has greater thermal conductivity than the conventionally used alumina is used as the material of the substrate 7. Therefore, during printing operation, transfer and conduction of heat from the heat-generating portion to the substrate 7 is reduced as compared with the case where the porous silicon oxide layer 16 is not provided, thus offering a higher printing efficiency. On the other hand, when the generation of heat is caused, the temperature of the heat-generating portion 6 can be lowered in a shorter time than in the case where the porous silicon oxide layer is formed over a wider area, i.e., as compared with the thermal head of the first embodiment, thereby attaining a higher printing speed.

The term "only on the crest of the projection 8" is used to mean a region encircled by a circle which is centered at the center of the heat-generating portion 6 and which has a diameter about 5 to 10 μm greater than the distance between the portions of the conductor layer 4 diametrically opposing across the heat-generating portion 6.

The thermal head of this embodiment could be fabricated substantially by the same process as that for the thermal head of the first embodiment, except that the mask 11 used in the sub-step (1) in the second step of the process for the first embodiment was sized and shaped to cover only the crest of the projection 8.

As will be understood from the foregoing description, the present invention offers various advantages as follows.

First of all, it is stressed again that the printing quality can be remarkably improved by virtue of the fact that the heat-generating portion, which is formed above the projection on the silicon substrate, can be pressed onto an ink ribbon or a recording medium such as a heat-sensitive paper with sufficiently high contact pressure.

In particular, in the first embodiment of the invention, conduction and transfer of heat from the heat-generating resistor layer to the silicon substrate can be suppressed by the presence of the porous silicon oxide layer of 10 to 40 μm thick having a small thermal conductivity and covering the projection and the peripheral region surrounding the projection on the silicon substrate. As a consequence, electrical power consumption is reduced, which offers an additional advantage of improvement in printing efficiency in addition to the above described advantage of improved printing quality.

In the second embodiment, the porous silicon oxide layer 16 having small thermal conductivity is provided only on the crest of the projection in the silicon substrate so as to minimize the area of boundary between the porous silicon oxide layer and the heat-generating area. At the same time, a silicon wafer having a greater thermal conductivity than conventionally used alumina is employed as the material of the substrate. Therefore, during the printing, the transfer and conduction of heat from the heat-generating portion to the substrate is reduced as compared with the case where the porous silicon oxide layer is not provided, whereby the printing efficiency is increased. On the other hand, when the generation of heat is terminated, the temperature of the heat-generating portion can be lowered in a shorter time than in the case where the porous silicon oxide layer is formed over a wider area, i.e., as compared with the of first embodiment of the thermal head, thus attaining a higher printing speed.

Thus, the present invention provides a thermal head which is superior in printing quality, printing efficiency and printing speed as compared with known thermal heads.

What is claimed is:

1. A thermal head comprising:

a silicon substrate having a projection defining a peripheral portion and a centrally-located crest;

a porous silicon oxide layer formed on said projection;

a heat-generating resistor layer formed on said porous silicon oxide layer;

a conductor layer formed on said heat-generating resistor layer, said conductor layer defining an opening disposed adjacent said crest; and a protective layer formed to cover said heat-generating

2. A thermal head according to claim 1, wherein said porous silicon oxide layer is formed only on the crest.

3. A thermal head comprising:

a silicon substrate having a projection comprising a peripheral region having a first surface defining a first slope, a crest region centrally located within said peripheral region having a second surface defining a second slope and a peak region, said second slope being greater than said first slope, and a porous silicon oxide region formed in said central crest region;

a heat-generating resistor layer formed on said second surface; and a conductor layer formed on said heat-generating resistor layer over said second slope and defining an opening such that said peak region is exposed.

4. A thermal head according to claim 3 wherein said porous silicon oxide region is formed in said peripheral region and said crest of said projection.

5. A thermal head according to claim 4 wherein said porous silicon oxide region is 10 to 100 μm thick.

6. A thermal head according to claim 5 wherein said porous silicon oxide region is approximately 40 μm thick.

7. A thermal head according to claim 3 wherein said heat-generating resistor layer formed on said second surface and said first surface.

8. A thermal head according to claim 7 wherein said conductor layer is formed on said heat-generating resistor layer adjacent said second slope and said peripheral region.

9. A thermal head according to claim 3 further comprising a protective layer formed on said projection.

* * * * *